United States Patent [19]

Cerola

[11] Patent Number: 4,562,827

[45] Date of Patent: Jan. 7, 1986

[54] DOWNDRAFT COUNTERTOP COOKING RANGE

[75] Inventor: Joseph J. Cerola, Noblesville, Ind.

[73] Assignee: Roper Corporation, Kankakee, Ill.

[21] Appl. No.: 674,106

[22] Filed: Nov. 21, 1984

[51] Int. Cl.[4] ..... F24C 15/30

[52] U.S. Cl. ..... 126/299 R; 126/300; 98/115.1

[58] Field of Search ..... 126/299 R, 299 D, 299 C, 126/299 E, 300–302, 21 R, 21 A, 39, 39 J; 99/400; 98/115 R, 115 LH; 55/DIG. 36

[56] References Cited

U.S. PATENT DOCUMENTS

| | | | |
|---|---|---|---|
| 1,896,951 | 2/1933 | Hahn | 98/115 R |
| 3,596,650 | 8/1971 | Cerola | 126/300 |
| 4,291,668 | 9/1981 | Moeller | 98/115 R |
| 4,432,274 | 2/1984 | Kurotaki | 126/299 E |

FOREIGN PATENT DOCUMENTS

| | | | |
|---|---|---|---|
| 100240 | 8/1981 | Japan | 126/299 C |
| 153137 | 9/1982 | Japan | 126/299 R |
| 187537 | 11/1982 | Japan | 126/299 R |
| 104431 | 6/1983 | Japan | 126/299 D |

*Primary Examiner*—James C. Yeung
*Attorney, Agent, or Firm*—David J. Richter

[57] ABSTRACT

A downdraft countertop cooking range having an improved ventilation system for removing smoke and cooking odors from the entire cooking panel area. The range has a modular cooking panel recessed substantially below the countertop for enhanced accessibility from the front of the range. Exhaust louvers spaced between the ends of the cooking panel and the top edge of the range frame, and of substantially equal depth to that of the cooking panel, assure an adequate flow of exhaust air over the cooking panel area.

14 Claims, 9 Drawing Figures

FIG. 1
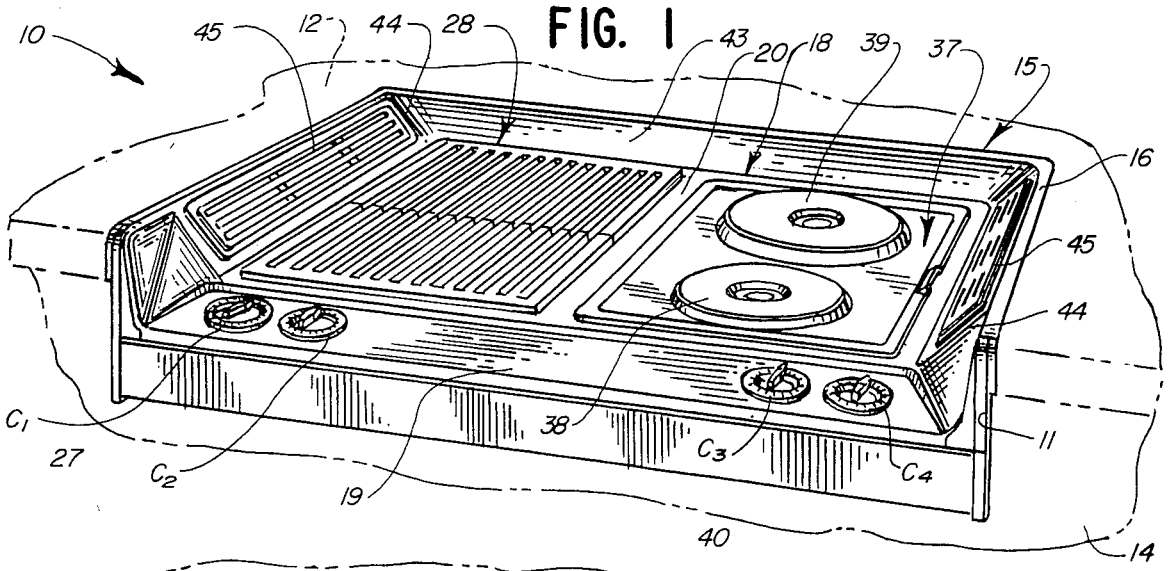
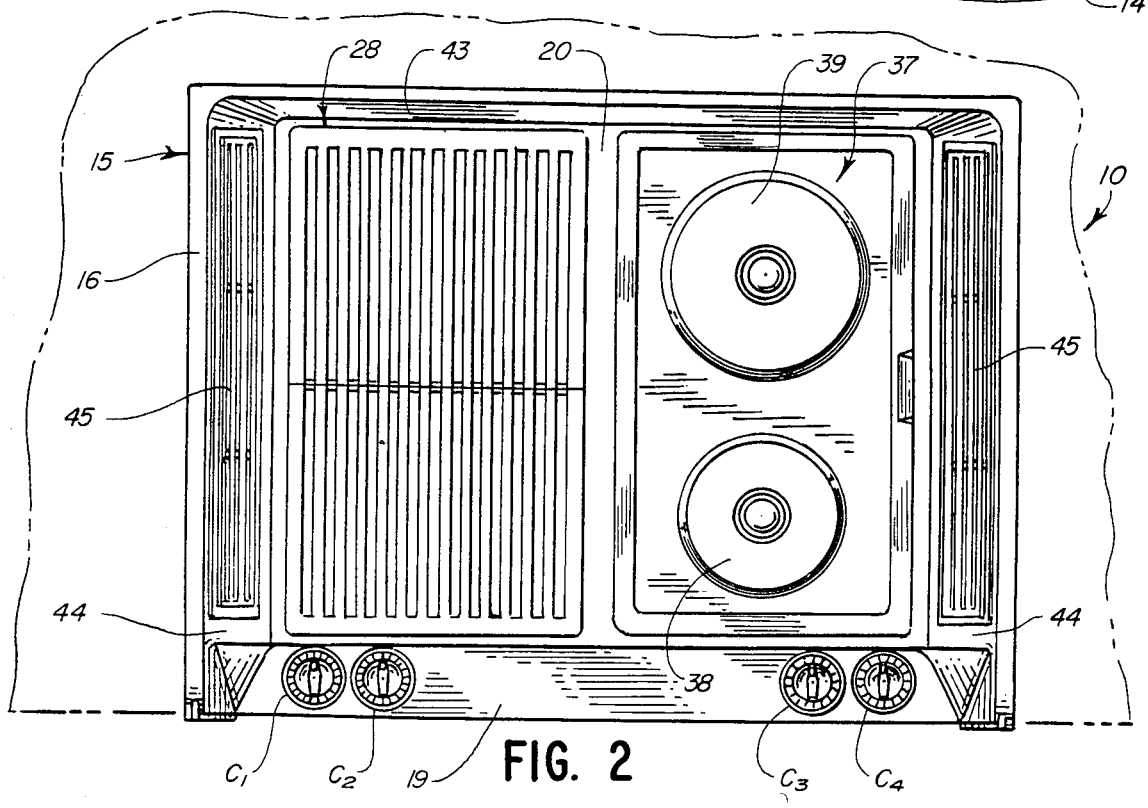
FIG. 2
FIG. 3
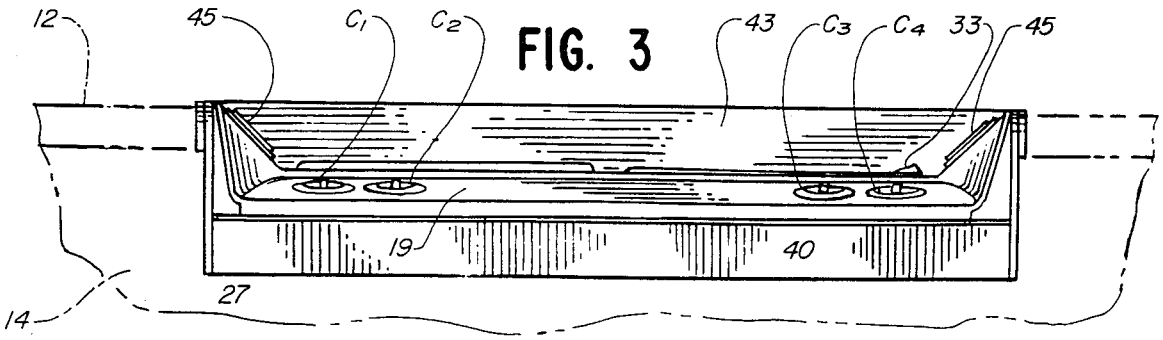

29
39
33
37
25
31
31
38
10
48
47
35
50
51
52
14
15
22
45
42
32
26
21
34
19
53
34
48
24
54
52
47
50
51
10
48
35
50
51
52

DOWNDRAFT COUNTERTOP COOKING RANGE

The present invention relates in general to ventilated countertop cooking ranges and, more particularly, to a cooking range of this type having an improved downdraft ventilation system capable of disposing of smoke and other cooking emissions from the entire cooking panel area.

BACKGROUND OF THE INVENTION

Countertop cooking ranges of the downdraft ventilated type have been the subject of much attention heretofore. Examples of such units are shown inn the following prior art patents:

| U.S. Pat. No. | Patentee | U.S. Pat. No. | Patentee |
|---|---|---|---|
| 3,102,533 | Jenn et al. | 3,756,217 | Field |
| 3,367,320 | Jenn et al. | 3,797,375 | Cerola |
| 3,444,805 | Happel et al. | 4,034,663 | Jenn et al. |
| 3,474,724 | Jenn | 4,335,705 | Kurotaki |
| 3,596,650 | Cerola | D 207,369 | Field |
| | | D 210,336 | Jenn et al. |

Notwithstanding an imposing body of prior art, there still exists a genuine need for improving the accessibility, performance, safety and versatility of this type of domestic cooking range.

SUMMARY OF THE INVENTION

One object of the present invention is to provide a downdraft countertop cooking range having a cooking panel recessed substantially below the countertop for enhanced accessibility from the front of the range.

Another object of the invention is to provide a countertop cooking range of the foregoing type having an improved downdraft ventilation system adapted to exhaust cooking fumes effectively over the entire area of the cooking panel through louvers spaced laterally therefrom and extending substantially the full depth of the cooking panel.

A further object of the invention is to provide a downdraft cooking range of the above character with a cooking panel recessed below the countertop and exhaust louvers spaced laterally from the cooking panel between the latter and the top edge of the range.

Another object of the invention is to provide a cooking range of the character set forth above which is adapted to preclude the build up of excessive heat in the peripheral areas of the range adjacent the surrounding countertop.

Other objects and advantages will become apparent as the following description proceeds, taken with the accompanying drawings.

BRIEF DESCRIPTION OF THE DRAWINGS

FIG. 1 is a perspective view of an illustrative downdraft countertop cooking range exemplifying the present invention.

FIG. 2 is a plan view of the exemplary cooking range shown in FIG. 1.

FIG. 3 is a front elevational view of the exemplary cooking range shown in FIG. 1.

Figures 4, 8, 9:
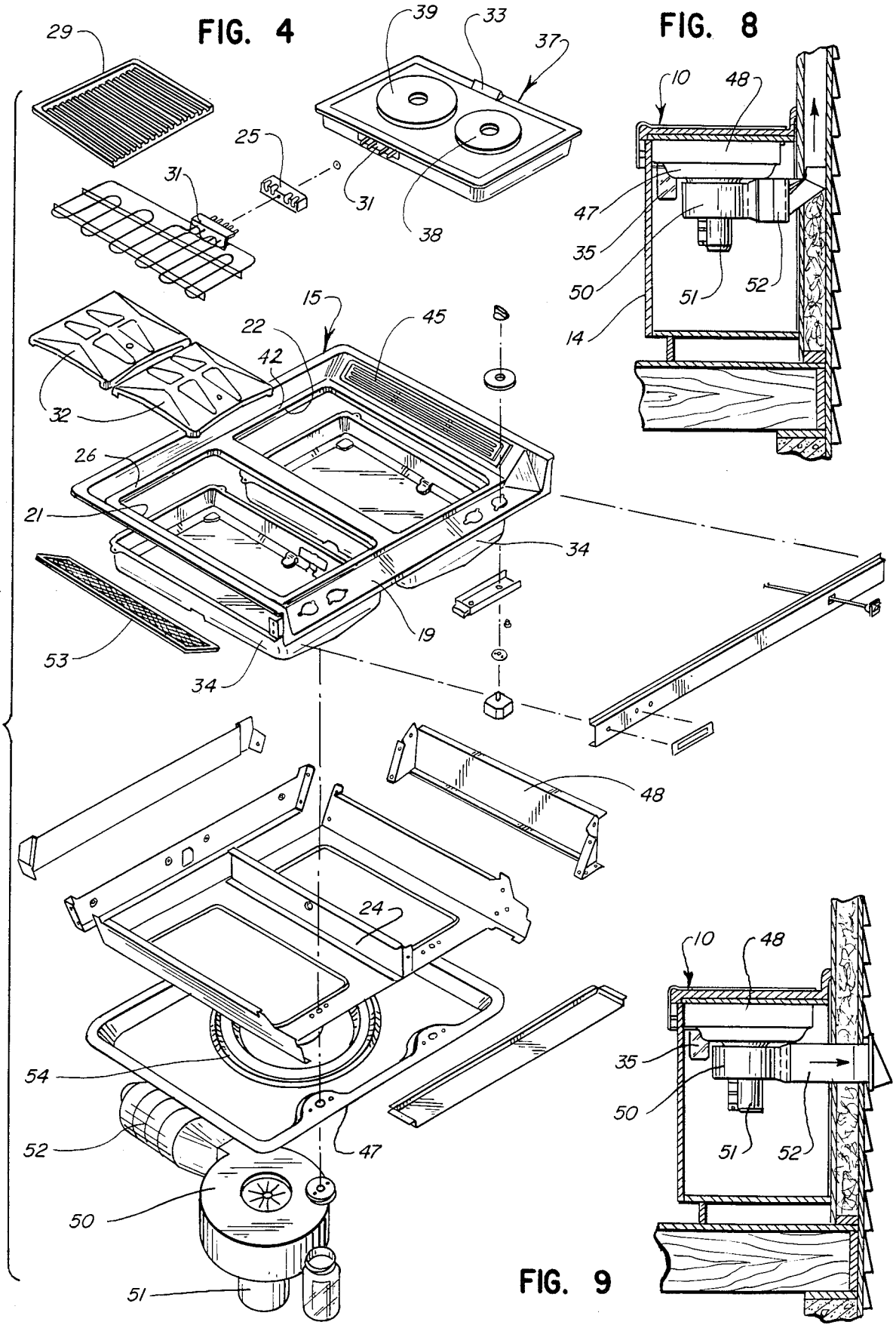
FIG. 4 is an exploded perspective view of the principal components of the range shown in FIG. 1.
FIG. 8 is a transverse sectional view through the counter and adjacent building wall showing the cooking range and one form of exhaust duct in elevation.
FIG. 9 is a transverse sectional view similar to FIG. 8 but showing a different form of exhaust duct.
Figure 5:
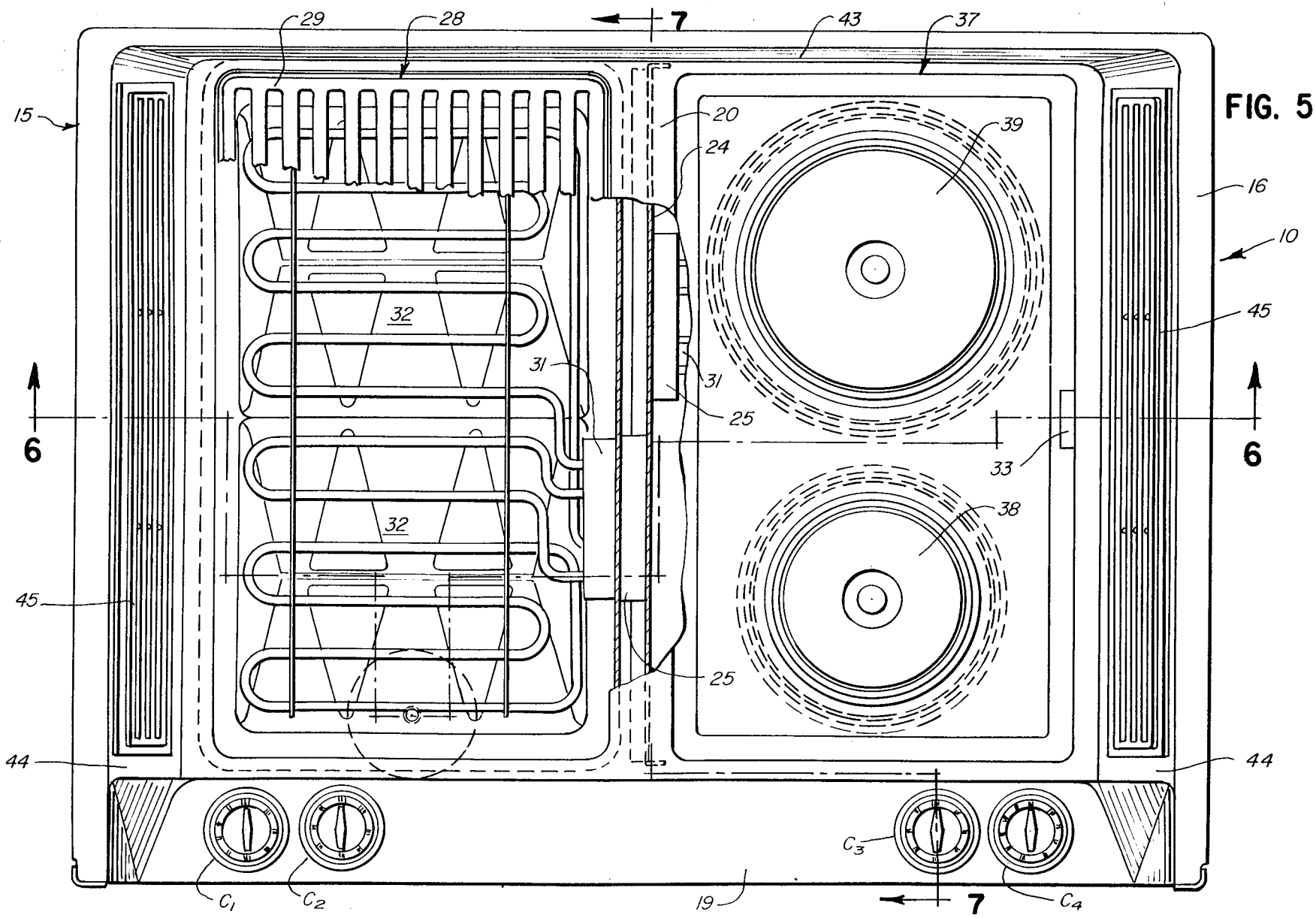
FIG. 5 is an enlarged plan view of the range shown in FIG. 1 with certain portions broken away to illustrate internal structure.

While the invention is susceptible of various modifications and alternative constructions, a certain illustrative embodiment has been shown in the drawings and will be described below in considerable detail. It should be understood, however, that there is no intention to limit the invention to the specific form disclosed, but, on the contrary, the intention is to cover all modifications, alternative constructions, and equivalents falling within the scope of the appended claims.

DETAILED DESCRIPTION OF THE INVENTION

Referring more specifically to FIGS. 1–3 of the drawings, the invention is there exemplified in an illustrative downdraft cooking range 10 of the domestic type. In the present instance, the range 10 is nested within a large opening 11 in the countertop 12 and front wall 14 of the counter. The range comprises a main top frame 15 of generally rectangular form having a marginal edge portion 16 overlying the countertop on three sides and suspending the range within the counter.

The range 10 has a cooking panel 18 and a control panel 19 adjacent thereto, the latter having a slight downward slope toward the front edge of the main top frame 15 (FIGS. 1–6). A central divider 20 separates the cooking panel into two generally rectangular apertures 21, 22 for receiving the heating elements. The divider 20 has a vertical wall 24 extending longitudinally below it which serves as a support for a pair of electric plug-in receptacles 25, one on either side of the vertical wall 24. The latter are adapted to engage the plug connectors of the respective heating elements of the range.

In the present instance, the range 10 has an indoor grill module 28 mounted in the left hand aperture 21 of the cooking panel (as viewed from the front). The grill module 28 comprises a support grate 29 for the food product being broiled, a heating element 30, and a reflector and support member 32. For ease of handling, the grate 29 is made in two parts, both supported on the lip 26 surrounding the aperture 21. The heating element 30 has a plug connector 31 adapted to engage the electrical receptacle 25, and support bars which rest upon the underlying reflector and support member 32. A grease well 34 is located beneath the member 32 and drains into a grease collection receptacle 35. The foregoing components are enclosed within a generally rectangular, pan-shaped housing 36 secured to the underside of the main top frame 15.

The heating element 30 of the grill module 28 is divided into two sub-elements, one for use in the front half of the grill and the other for use in the rear half. In the event that a large item is to be cooked, both sub-elements may be energized at the same time. The element 30 is actuated by the control knobs $C_1$ and $C_2$ on the panel 19. Indicator lamp 27 shows when the element 30, or any other heating element, is energized.

The right hand aperture 22 of the cooking panel receives a heater module 37 holding two individual heating elements 38, 39, the former smaller than the latter. Each such element in this instance happens to be constructed as a conventional range top resistance element in the form of a flat annular disc. The module 37 has a plug connector 31 disposed in engagement with one of the plug-in receptacles 25 and is supported on a lip 42 surrounding the right hand aperture 22. A small handle 33 is provided on the module 37 to facilitate plugging and unplugging of the heating elements. A grease well 34 underlying the heater module 37 is suspended and supported below the aperture 22 by the main top frame 15.

The elements 38, 39 are controlled by knobs $C_3$ and $C_4$ on the panel 19. It might be noted that the heating elements 38, 39 may also be of conventional flat spiral form.

It will be appreciated from the foregoing that the grill module 28, and heater module 37, are interchangeable with each other in the right hand and left hand apertures 22 and 21. By providing two plug-in receptacles 25, one on each side of the vertical dividing wall 24, it is possible to reverse the position of the grill module 28 and its heating element 30, and the position of the module 37 and heating elements 38, 39. In other words, the grill module and its heating element 30 can be shifted from the left hand side to the right hand side of the cooking panel 18, and the module 27 with its heating elements 38, 39 can be shifted from the right hand to the left hand side of the panel 18.

In accordance with the present invention, provision is made in the range 10 for maximizing the accessibility of the modular cooking panel 18 while affording highly effective downdraft ventilation thereof with highly efficient use of space. This is accomplished by recessing the cooking panel 18 and control panel 19 a substantial distance below the upper edge of the main top frame 15, which is the offset space, and by taking advantage of the offset space to locate downdraft exhaust louvers 45 in spaced relation with the ends of the cooking panel and the upper edge of the main top frame 15.

Referring more specifically to FIGS. 1–3 and 5–7, it wll be noted that the side panels 44 are spaced apart from the adjacent ends of the cooking panel and are inclined at an angle of approximately 45° with respect to the plane of the latter. The side panels 44 and their respective louvers 45 thus diverge outwardly and upwardly with respect to each other. The louvers 45 correspond substantially in length to the front-to-rear dimension or depth of the cooking panel 18.

An uninterrupted rear panel 43 in this case is interposed in upstanding relation between the cooking panel and the marginal edge portion 16 of the main top frame 15.

Figure 6:
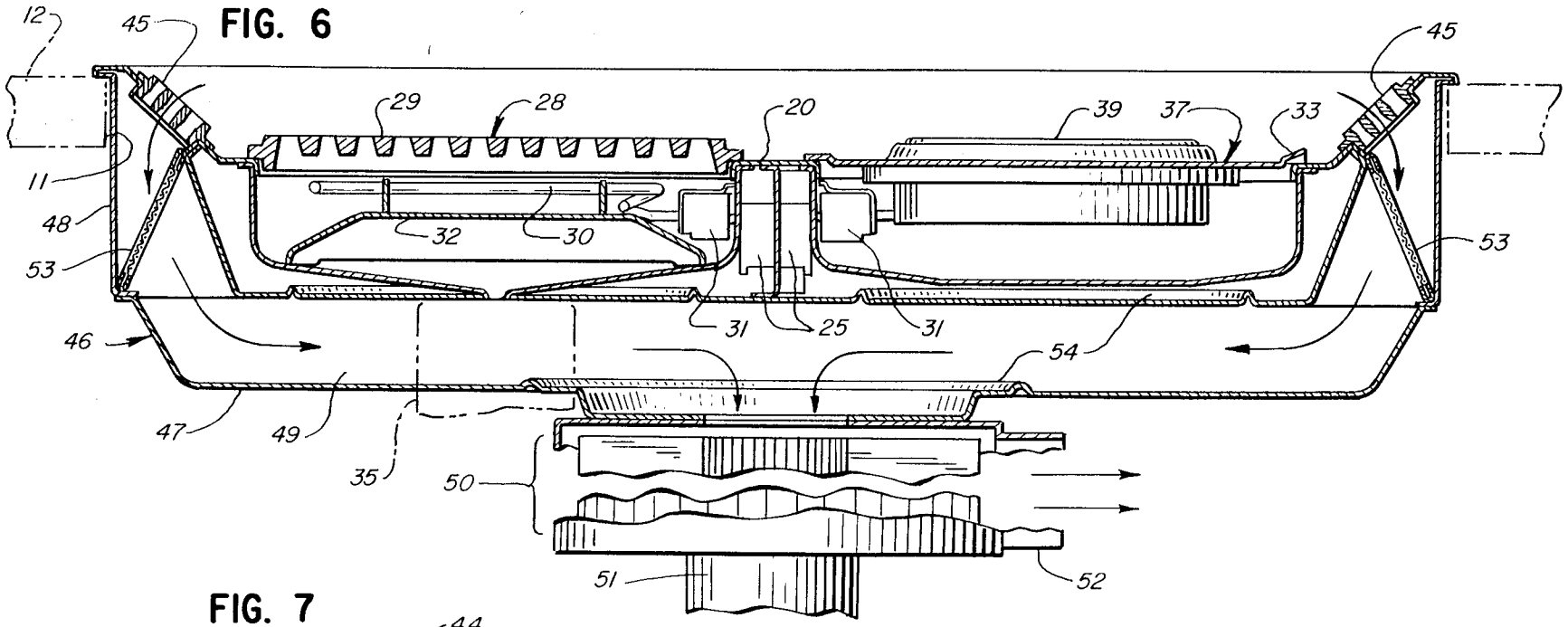
FIG. 6 is an enlarged, broken, vertical sectional view taken longitudinally of FIG. 5 in the plane of the line 6—6.
Figure 7:
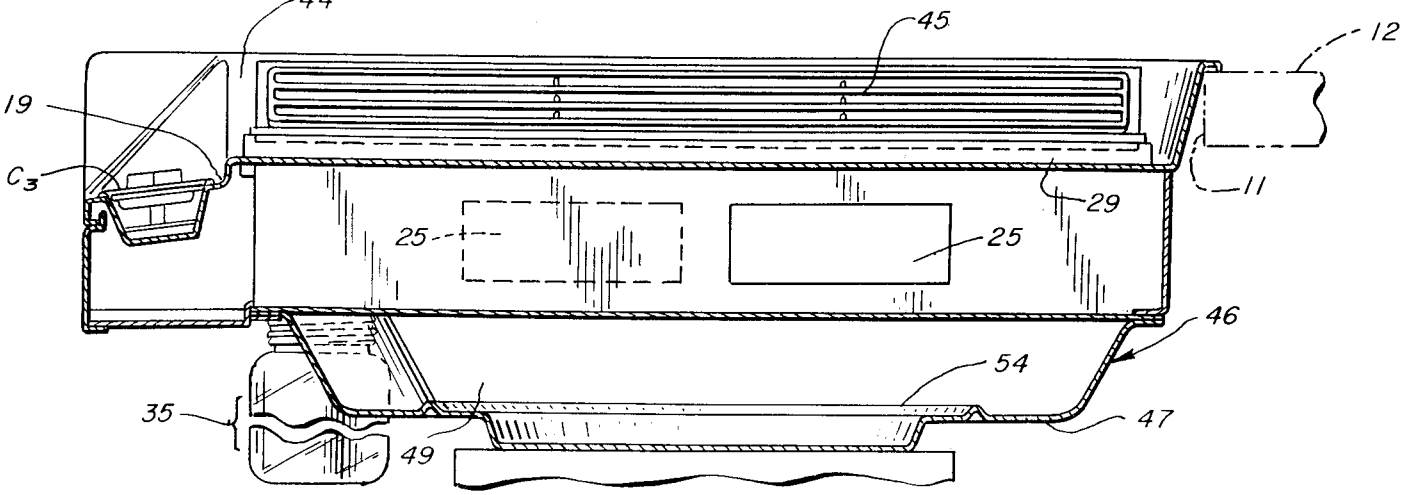
FIG. 7 is an enlarged, broken vertical sectional view taken laterally of FIG. 5 in the plane of the line 7—7.

Each louver 45 open into a plenum 46 surrounding the sides and bottom of the range 10. As shown in FIG. 6, the plenum 46 comprises a pair of air ducts 48 enclosing the rear faces of the side panels 44 and opening into a large plenum chamber 49 defined by plenum pan 47 underlying the range assembly. An exhaust fan 50 driven by motor 51 is mounted under the central portion of the plenum 46. The fan 50, controlled by switch 40, is adapted to draw air and cooking fumes from the cooking panel area through louvers 45, ducts 48 and plenum chamber 49, exhausting them to the outside through an appropriate vent duct 52. The exhaust vent may take various configurations, two of which are diagrammatically shown in FIGS. 8 and 9, respectively.

The air ducts 48 are adapted to house a pair of grease collecting filters 53. These filters are situated behind and below the louvers 45 and each extends across the entire cross section of the duct 48. They are of aluminum mesh construction as typically used in range applications.

In certain instances, grease accumulated in or around the filters may tend to melt and float down the plenum pan 47 toward the exhaust fan 50. To preclude entry of such grease into the fan, a raised bead 54 is formed in the plenum pan 47 to serve as a stop or dam. The bead 54 is continous and surrounds the entire opening to the exhaust fan 50.

It will be appreciated from the foregoing that the ventilating system described above provides a powerful flow of air across the entire cooking panel. The system has adequate capacity to capture and remove smoke and other cooking emissions regardless of whether the cooking panel is only partially used or loaded to its fullest capability. The flow of air and its distribution within the range provide an important safeguard against fire hazards.

I claim as my invention:

1. A downdraft range adapted for countertop mounting and comprising in combination:

(a) a main top frame adapted to overlie a recess in a countertop and having an overlapping marginal edge portion suspending the range in said recess;

(b) a cooking panel in said main top frame recessed substantially below said overlapping marginal edge portion;

(c) an upstanding rear panel interposed between said cooking panel and said overlapping marginal edge portion of said top from;

(d) a pair of outwardly diverging side panels extending from the level of said cooking panel to the level of said overlapping margimal edge portion of said top frame, each said side panel having a front-to-back depth substantially equal to the depth of said cooking panel;

(e) a ventilating louver in each said upwardly diverging side panel having openings commencing at about the level of said cooking panel; and (f) means including a suction fan situated below said main top frame and communicating with said ventilating louvers to exhaust smoke and cooking odors from said cooking panel.

2. The combination set forth in claim 1 which further comprises:

(a) air ducts extending along the sides of the recessed portion of said main top frame and communicating with said ventilating louvers in said diverging side panels;

(b) a plenum connected to said air ducts; and (c) an exhaust fan operationally connected to said plenum.

3. The combination set forth in claim 1, wherein each said diverging side panel is oriented at an angle of approximately 45 degrees with respect to the plane of said cooking panel.

4. The combination set forth in claim 1, wherein said main top frame includes a control panel adjacent the front edge thereof, said control panel being disposed below said cooking panel.

5. The combination defined in claim 2, wherein said exhaust fan has a connection for attachment of an exhaust duct.

6. The combination defined in claim 1 which further comprises:

(a) a housing having an inclined wall enclosing the underside of said cooking panel;

(b) a pair of air ducts each defined by said inclined wall of said housing, the underside of one of said side panels, and an outer wall;

(c) means defining a plenum chamber including the bottom of said housing and a plenum pan, said plenum chamber communicating with said air ducts; and (d) an exhaust fan operationally connected with said plenum chamber.

7. The combination of claim 1, wherein said cooking panel includes a grill module and at least one conventional heating unit.

8. The combination of claim 1, wherein said cooking panel comprises a grill module and a conventional heating unit module.

9. The combination of claim 8, wherein the positions of said grill module and conventional heating module may be interchanged back and forth in said cooking panel.

10. The combination set forth in claim 1, wherein said exhaust means includes a plenum bottom having an opening for communication with said suction fan, an upraised bead in the plenum bottom, said bead being continuous and surrounding said opening whereby grease which may accumulate in said plenum is blocked from flowing through said opening and into said suction fan.

11. A downdraft range comprising in combination:

(a) a main top frame having raised side and back panels;

(b) a cooking panel in said main top frame recessed substantially below the top edges of said side and back panels;

(c) said side panels being upwardly diverging from the level said cooking panel to the level of the top edges, each said side panel having a front-to-back depth substantially equal to the depth of said cooking panel;

(d) a ventilating louver in each said upwardly diverging side panel having openings commencing at about the level of said cooking panel; and (e) means including a suction fan situated below said main top frame and communicating with said ventilating louvers to exhaust smoke and cooking odors from said cooking panel.

12. The combination set forth in claim 4 in which said control panel has a downwardly sloping orientation towards the front edge of said main top frame.

13. A downdraft range adapted for mounting in a cmountertop having a recess with a plurality of peripheral sides comprising in combination:

(a) a main top frame having marginal edge portions for positioning in overlapping relation with respective of said peripheral sides of said recess for suspending said range in said recess;

(b) a cooking panel in said main top frame recessed substantially below said marginal edge portions;

(c) an upstanding rear panel interposed between said cooking panel and a rear marginal edge portion of said top frame;

(d) a pair of upwardly diverging side panels interposed between said cooking panel and respective side marginal edge portions of the top frame, said side panels extending from the level of said cooking panel to the level of said side marginal edge portions of the top frame;

(e) said side panels defining ventilating openings; and (f) means including a suction fan situated below said main top frame and communicating said said ventilating openings to exhaust smoke and cooking odors from said cooking panel.

14. The combination set forth in claim 13 in which a forward marginal edge portion of said top frame is disposed at a level below the level of said cooking panel, and including a control panel mounted between said forward marginal edge portion and said cooking panel.

* * * * *